US006524067B1

(12) United States Patent
Chen et al.

(10) Patent No.: US 6,524,067 B1
(45) Date of Patent: Feb. 25, 2003

(54) AIRFLOW-GUIDING FAN GUARD

(75) Inventors: Chang Shun Chen, Taoyuan Shien (TW); Kuo-Cheng Lin, Taoyuan Shien (TW); Wen-Shi Huang, Taoyuan Shien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/614,941

(22) Filed: Jul. 12, 2000

(30) Foreign Application Priority Data

Nov. 3, 1999 (TW) ..... 88218737 U

(51) Int. Cl.[7] ..... F04D 29/54
(52) U.S. Cl. ..... 415/208.5; 415/223; 416/247 R
(58) Field of Search ..... 415/175, 176, 415/208.2, 208.5, 182.1, 223; 416/247 R; 417/354; 361/695, 687, 685, 727

(56) References Cited

U.S. PATENT DOCUMENTS

D296,587 S * 7/1988 Dodson ..... D23/370
4,806,081 A * 2/1989 Harmsen et al. ..... 417/354
5,407,324 A * 4/1995 Starns, Jr. et al. ..... 415/208.5
5,575,619 A * 11/1996 Chen ..... 415/110
5,629,834 A * 5/1997 Kodama et al. ..... 361/695
5,803,709 A * 9/1998 Matthews et al. ..... 415/182.1
6,196,802 B1 * 3/2001 Matsumoto ..... 415/216.1

* cited by examiner

*Primary Examiner*—Edward K. Look
*Assistant Examiner*—Richard A. Edgar
(74) *Attorney, Agent, or Firm*—Niro, Scavone, Haller & Niro

(57) ABSTRACT

A fan guard for guiding airflow to dissipate heat generated from a heat-generating device has an airflow inlet disposed on an upper portion of the fan guard for introducing the airflow into an interior of the fan guard, an airflow outlet disposed on a lower portion of the fan guard for enabling the airflow to flow out of the fan guard and to the heat-generating device, and a plurality of ribs disposed in the airflow outlet of the fan guard for separating the airflow outlet into a plurality of isolated flow paths. In addition, the inner diameter of the airflow outlet is smaller than that of the airflow inlet, and there is a space formed between the ribs of the fan guard and the heat-generating device for enhancing the heat-dissipating efficiency.

16 Claims, 5 Drawing Sheets

AIRFLOW-GUIDING FAN GUARD

FIELD OF THE INVENTION

The present invention is related to a fan guard for guiding an airflow, and particularly to a fan guard for guiding an airflow to dissipate heat generated from an electronic device.

BACKGROUND OF THE INVENTION

As time goes by, the electronic devices are further miniaturized and the circuits are designed to further increase density for improvement of speed, performance, and power efficiency. However, this trend arises several problems. One of the problems is the heat generated from the electronic devices, which will shorten the useful lifetime of the electronic devices. At the present time, the heat removal from the electronic devices for allowing the electronic devices to perform normally has attracted great attention.

Generally, three different ways are adopted to solve the problem of heat generated from the electronic devices.

(1) Focusing on the design of circuits.

Though it's possible to design simpler electronic circuits, it's really hard to look after both the problem of heat and the performance of electronic devices.

(2) Focusing on the design of radiator plate.

At the present time, the radiator plates are generally made of aluminum. For solving the problem of heat generated from the electronic devices, a variety of the radiator plates may be formed possibly by a way of injection molding of aluminum. As we know, a radiator plate with more surface area may solve the problem of heat generated from the electronic devices. Unfortunately, there is no longer any space for advancement in the design of radiator plate. In addition, it will take a longer time to develop a new material for replacing aluminum to solve the above-described problem.

(3) Focusing on the design of the fan assembly.

Most researchers focus on the design of the motor of the fan assembly for improving the heat-dissipating efficiency.

Please refer to FIG. 1 showing a combination of the conventional fan assembly, the radiator plate and the electronic device. The conventional fan assembly includes a fan 17 and a fan guard 13. The fan further includes a stator 11, a rotor 12 and a plurality of blades 121 which are disposed on the rotor 12 for generating an airflow by revolution. The airflow flows into the fan assembly from the airflow inlet of the fan assembly 151 and out from the airflow outlet of the fan assembly 152 to the radiator plate 14. Thereafter, the airflow passes through the gap of the radiator plate 141 to lower its temperature. Because the electronic device 16 is contacted with the radiator plate 14, the heat generated from the electronic device 16 is transferred to the radiator plate 14 and dissipated by the airflow from the airflow outlet 152 of the fan assembly. Alternatively, the airflow out from the airflow outlet of the fan assembly 152 can flow directly onto the electronic device 16 through the gap of the radiator plate 141.

The electronic circuit is generally disposed on a central surface of an electronic device. However, for the conventional fan assembly, the diameters of the airflow outlet and inlet of the fan assembly for passing through an airflow are the same so that the airflow out from the airflow outlet of the fan assembly 152 is not easy to directly flow toward the central surface of the electronic devices. Therefore, the heat-dissipating efficiency of the conventional fan assembly is limited.

In addition, the stator of the conventional fan assembly directly contacts on the surface of the radiator plate 14, thereby blocking the airflow out from the airflow outlet of the fan assembly 152 from directly flowing onto the central surface of the electronic devices. Therefore, it is desirable to solve the problem encountered by the prior arts, that is, the heat-dissipating problem of the electronic devices.

SUMMARY OF THE INVENTION

An object of the present invention is to provide a fan guard for guiding an airflow toward the central surface of the electronic devices to effectively dissipate heat generated from the electronic devices.

Another object of the present invention is to provide a fan assembly for guiding airflow toward the central surface of the electronic devices to improve the speed, performance, and power efficiency and to elongate the useful lifetime of the electronic devices.

The fan assembly comprises a fan for generating airflow by revolution and a fan guard, wherein the fan guard has an airflow inlet disposed on an upper portion of the fan guard for introducing the airflow into an interior of the fan guard, and an airflow outlet disposed on a lower portion of the fan guard for enabling the airflow to flow out of the fan guard and to the heat-generating device. In addition, the inner diameter of the airflow outlet is smaller than that of the airflow inlet, thereby concentrating the airflow flowing out of the airflow outlet toward the heat-generating device to dissipate heat generated from the heat-generating device. The fan guard further includes a plurality of ribs disposed in the airflow outlet of the fan guard and separating the airflow outlet into a plurality of isolated flow paths. There is a space formed between the ribs of the fan guard and the heat-generating device for enhancing the heat-dissipating efficiency. Besides, a radiator plate is mounted between the heat-generating device and the fan guard for transmitting the heat generated from the heat-generating device, wherein heat-generating device can be an electronic device. Accordingly, the heat generated from the heat-generating device can be dissipated by the airflow guided through the fan guard.

The present invention may best be understood through the following description with reference to the accompanying drawings, in which:

BRIEF DESCRIPTION OF THE DRAWING

FIG. 2(*b*) is a schematic diagram showing a first preferred embodiment of the fan and the fan guard for guiding airflow according to the present invention;

DETAILED DESCRIPTION OF THE PREFERRED EMBODIMENTS

Figure 1:
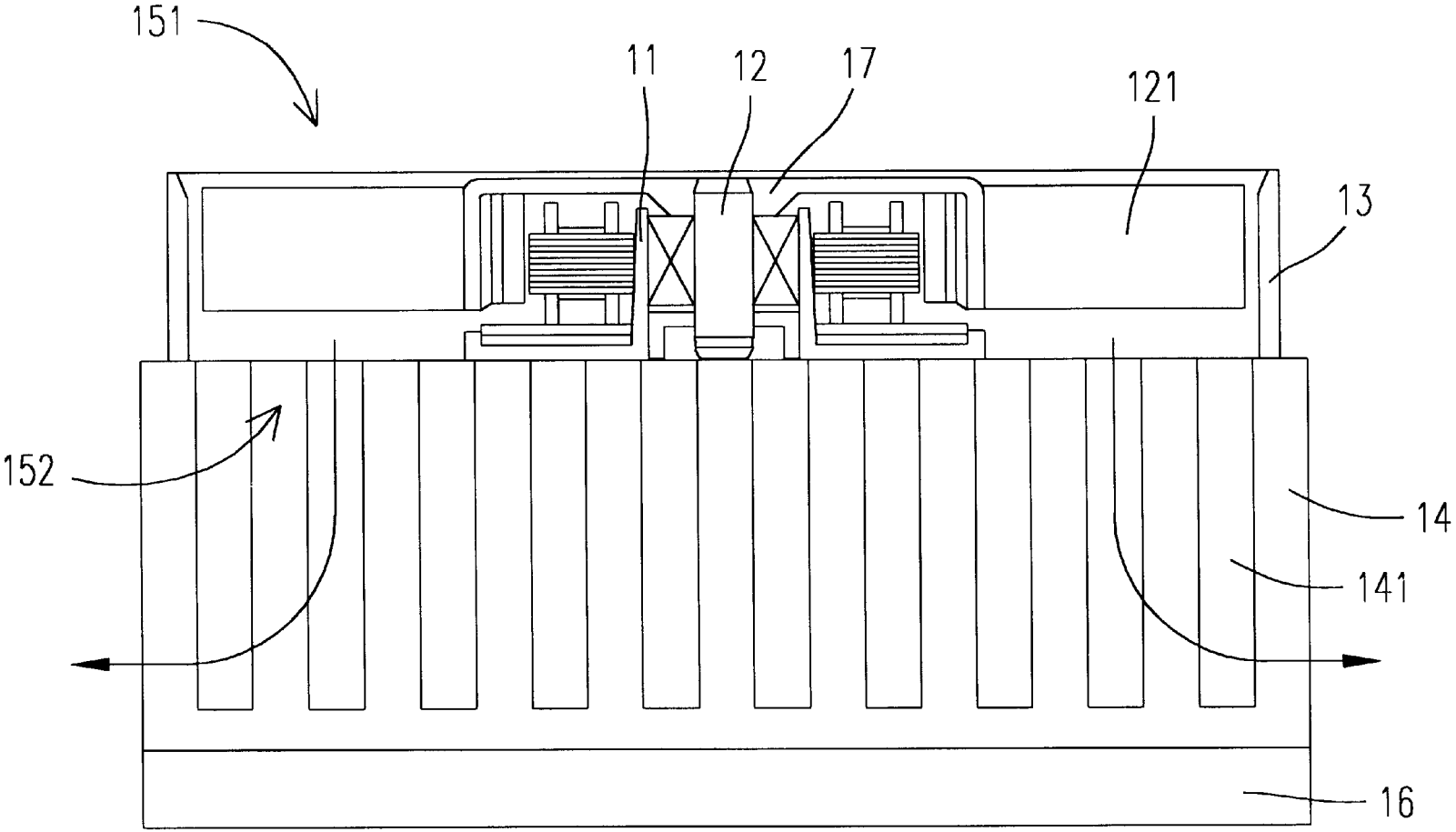
Fig. 1(PRIOR ART)
FIG. 1 is a schematic diagram showing a combination of the conventional fan assembly, the radiator plate and the electronic device.
Figure 2A:
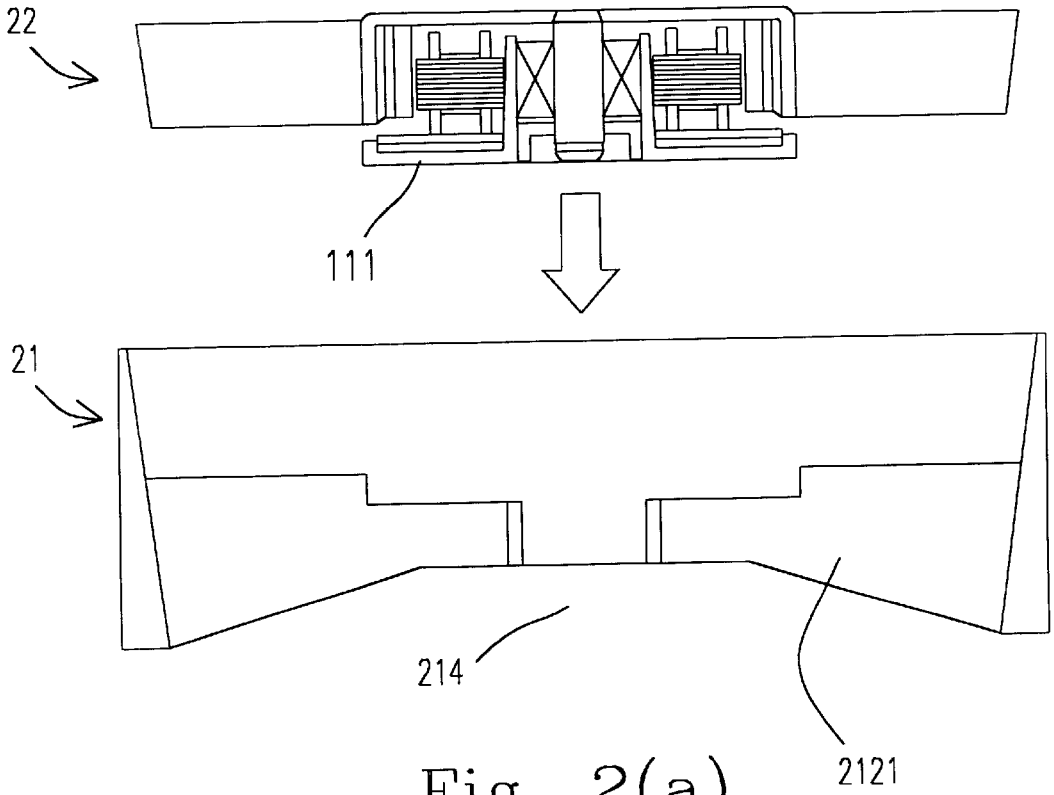
FIG. 2(*a*) shows how to assemble the fan guard and the fan according to the present invention.
Figure 2B:
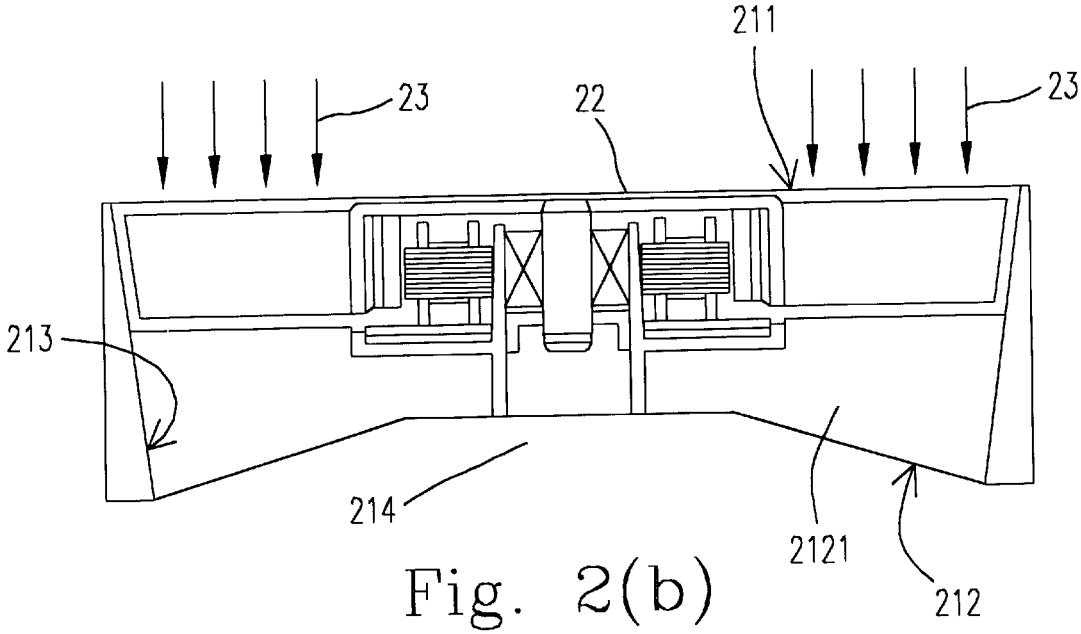

Please refer to FIG. 2(*a*) which shows how to assemble the fan guard with the fan according to the present invention. The fan 22 assembles directly with the fan guard by gluing the base 111 of the fan to the ribs 2121 of the fan guard.

Please refer to FIG. 2(*b*) which is a schematic diagram showing a combination of the fan and the fan guard for guiding airflow according to the present invention. The fan guard has an airflow inlet 211 disposed on one side (or upper portion as shown in FIG. 2(*a*)) of the fan guard for introducing an airflow 23 into the fan guard, and an airflow outlet 212 disposed on the other side (or lower portion) of the fan guard for enabling the airflow 23 to flow out of the fan guard to the radiator plate. The fan 22 is incorporated in the airflow inlet of the fan guard and the base 111 of the fan is secured on the ribs 2121 of the fan guard. A slope 213 is formed around the interior periphery of the fan guard, resulting in that the diameter of the airflow outlet 212 is smaller than that of the airflow inlet 211. Therefore, while the airflow 23 is introduced into the fan guard, the airflow 23 flows through the fan guard, and thus concentrated toward the central area of the electronic device or the radiator plate due to the slope 213. As a result, the temperature of the radiator plate can be effectively lowered and heat generated from the electronic device can be effectively dissipated as well. A plurality of ribs 2121 of the fan guard are disposed in the airflow outlet 212 of the fan guard and separate the airflow outlet 212 into a plurality of isolated flow paths. There is a space formed between the ribs of the fan guard and the heat-generating device for enhancing the heat-dissipating efficiency.

In general, the radiator plate is used to contact with the electronic device, such as a central process unit, for transmitting the heat generated from the electronic device. Even if the radiator plate doesn't exist between the fan assembly and the electronic device, the efficiency for dissipating heat generated from the electronic devices can be also improved as long as the airflow is guided through the fan guard of the present invention.

Figure 3:
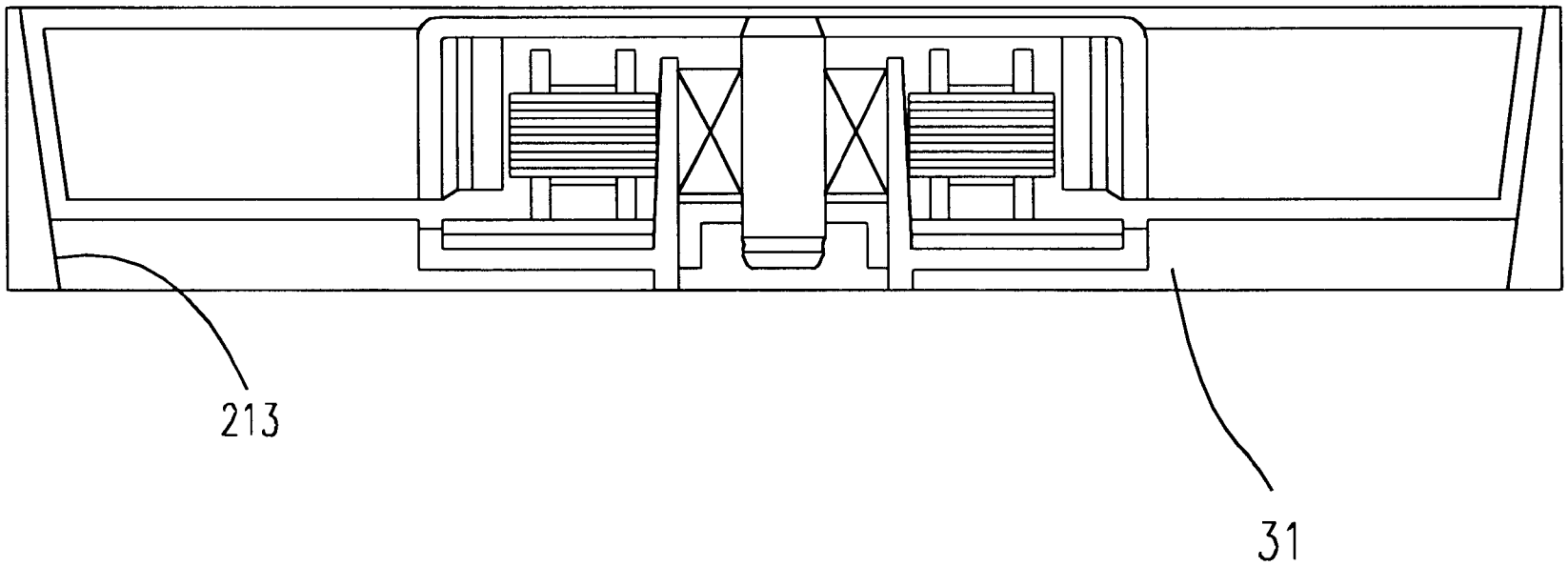
FIG. 3 is a schematic diagram showing a second preferred embodiment of the fan and the fan guard for guiding airflow according to the present invention.

Please refer to FIG. 3 which is a schematic view showing another combination of the fan and the fan guard for guiding airflow according to the present invention. The difference between FIG. 2 and FIG. 3 is the design in the architecture of the ribs. In FIG. 2, there is a space 214 formed between the ribs of the fan guard and the heat-generating device for enhancing the heat-dissipating efficiency. In FIG. 3, no space is formed between the fan guard and the radiator plate. In both embodiments, however, the inner diameters of the airflow inlet and the airflow outlet are gradually decreased from up to down. That is, the inner diameter of the airflow outlet is smaller than that of the airflow inlet. Therefore, the airflow can be concentrated and guided through the fan guard toward the central area of the electronic devices in both embodiments. Accordingly, heat generated from the electronic devices can be effectively dissipated in these two embodiments.

Figure 4:
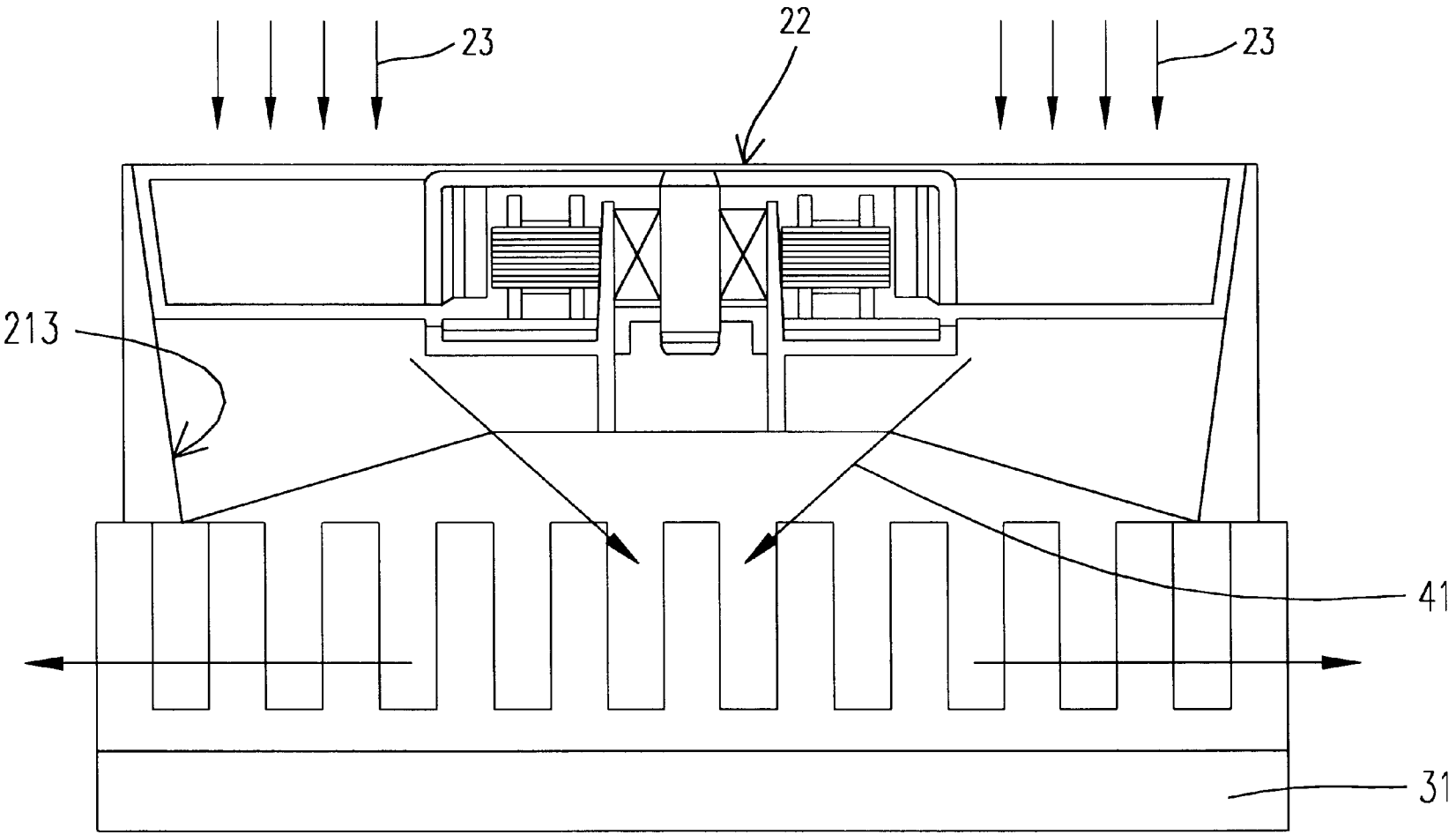
FIG. 4 is a schematic diagram showing a combination of the fan assembly and the radiator plate according to the present invention.

Please refer to FIG. 4 which is a schematic diagram showing a combination of the fan assembly and the radiator plate according to the present invention. While the airflow 23 flows into the fan guard, the airflow 23 is guided and concentrated toward the central area of the electronic device 31 due to the slope 213. Thus, temperature of the electronic devices can be lowered significantly.

Figure 5:
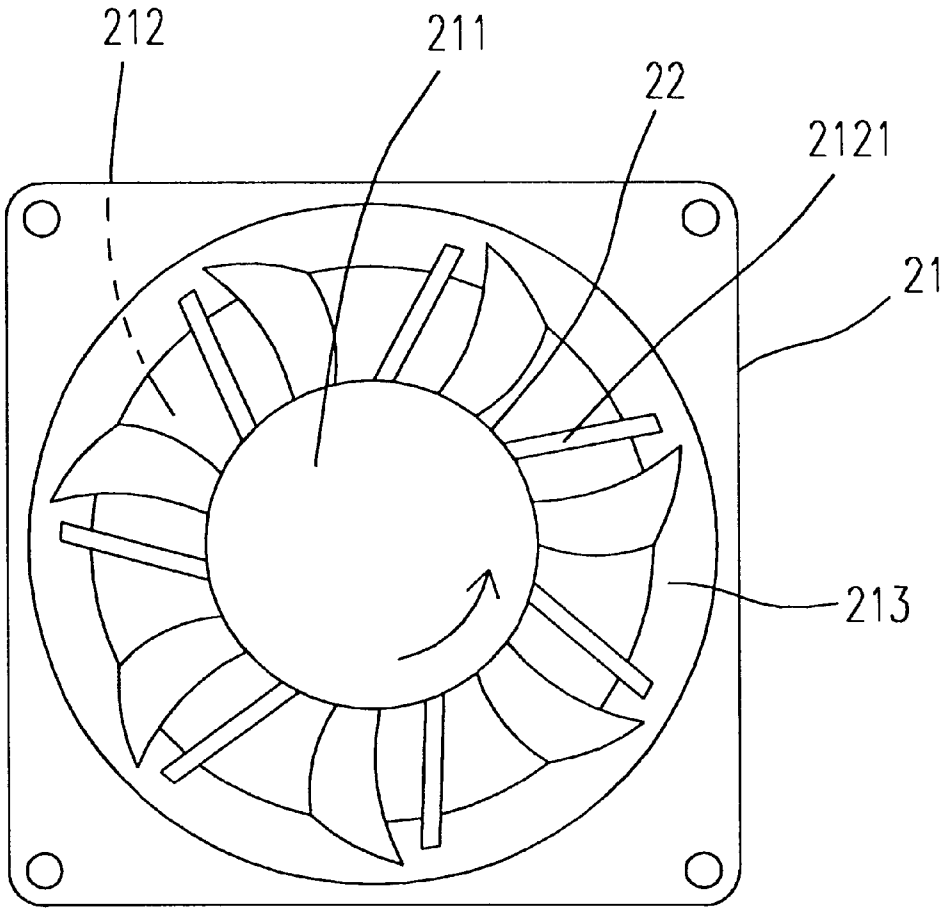
FIG. 5 is a top view showing the fan assembly for guiding airflow according to the present invention.

Please refer to FIG. 5 which is a top view showing the fan assembly for guiding airflow according to the present invention. A slope 213 is formed around the interior periphery of the fan guard 21, resulting in that the diameter of the airflow outlet 212 is smaller than that of the airflow inlet 211. A plurality of ribs 2121 are disposed in the airflow outlet 212 of the fan guard 21 and separate the airflow outlet into a plurality of isolated flow paths.

In conclusion, the efficiency of dissipating heat generated from the electronic device can be improved because a slope formed inside the fan guard results in that the inner diameter of the airflow outlet is smaller than that of the airflow inlet. Besides, a space is formed between the ribs of the fan guard and the heat-generating device for enhancing the heat-dissipating efficiency.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A fan guard for guiding an airflow to dissipate heat generated from a heat-generating device, having:

an airflow inlet disposed on an upper portion of said fan guard for introducing said airflow into an interior of said fan guard;

an airflow outlet integrally formed with said fan guard and disposed on a lower portion of said fan guard for enabling said airflow to flow out of said fan guard and to said heat-generating device; and a plurality of ribs disposed in said airflow outlet of said fan guard for separating said airflow outlet into a plurality of isolated flow paths, wherein the inner diameter of said airflow outlet is smaller than that of said airflow inlet to form a continuous slope from said inlet to said outlet.

2. The fan guard according to claim 1 wherein said fan guard has a slope formed around the interior periphery of said fan guard.

3. The fan guard according to claim 1 wherein said fan guard is made of insulating material by injection molding.

4. The fan guard according to claim 1 wherein said heat-generating device is an electronic device.

5. A fan guard for guiding an airflow to dissipate heat generated from a heat-generating device, having:

an airflow inlet disposed on an upper portion of said fan guard for introducing said airflow into an interior of said fan guard;

an airflow outlet integrally formed with said fan guard and disposed on a lower portion of said fan guard for enabling said airflow to flow out of said fan guard and to said heat-generating device; and a plurality of ribs disposed in said airflow outlet of said fan guard for separating said airflow outlet into a plurality of isolated flow paths;

wherein the inner diameter of said airflow outlet is smaller than that of said airflow inlet to form a continuous slope from said inlet to said outlet, and there is a space formed between said ribs of said fan guard and said heat-generating device.

6. The fan guard according to claim 5 wherein said fan guard has a slope formed around the interior periphery of said fan guard.

7. The fan guard according to claim 5 wherein said fan guard is made of insulating material by injection molding.

8. The fan guard according to claim 5 wherein said heat-generating device is an electronic device.

9. A fan assembly for guiding an airflow to dissipate heat generated from a heat-generating device, comprising:

a fan for generating said airflow by revolution; and a fan guard disposed under said fan and having an airflow inlet disposed on an upper portion of said fan guard for introducing said airflow into an interior of said fan guard, an airflow outlet integrally formed with said fan guard and disposed on a lower portion of said fan guard for enabling said airflow to flow out of said fan guard and to said heat-generating device and a plurality of ribs disposed in said airflow outlet of said fan guard for separating said airflow outlet into a plurality of isolated flow paths, wherein the inner diameter of said airflow outlet is smaller than that of said airflow inlet to form a continuous slope from said inlet to said outlet, and there is a space formed between said ribs of said fan guard and said heat-generating device.

10. The fan assembly according to claim 9 wherein said fan guard has a slope formed around the interior periphery of said fan guard.

11. The fan assembly according to claim 9 wherein said fan guard is made of insulating material by injection molding.

12. The fan assembly according to claim 9 wherein said heat-generating device is an electronic device.

13. A fan assembly for guiding an airflow to dissipate heat-generated from a heat generating device, comprising:

a fan for generating said airflow by revolution; and a fan guard disposed under said fan and having an airflow inlet disposed on an upper portion of said fan guard for introducing said airflow into an interior of said fan guard, an airflow outlet integrally formed with said fan guard and disposed on a lower portion of said fan guard for enabling said airflow to flow out of said fan guard and to said heat-generating device and a plurality of ribs disposed in said airflow outlet of said fan guard for separating said airflow outlet into a plurality of isolated flow paths, wherein the inner diameter of said airflow outlet is smaller than that of said airflow inlet to form a continuous slope from said inlet to said outlet.

14. The fan assembly according to claim 13 wherein said fan guard has a slope formed around the interior periphery of said fan guard.

15. The fan assembly according to claim 13 wherein said fan guard is made of insulating material by injection molding.

16. The fan assembly according to claim 13 where said heat-generating device is an electronic device.

* * * * *